United States Patent [19]

Horsley

[11] 4,392,912

[45] Jul. 12, 1983

[54] BOBBIN CHANGER FOR JOINING SUCCESSIVE REELS OF WEB OF THE CIGARETTE INDUSTRY

[75] Inventor: John K. Horsley, High Wycombe, England

[73] Assignee: Molins Limited, London, England

[21] Appl. No.: 254,284

[22] Filed: Apr. 15, 1981

[30] Foreign Application Priority Data

Apr. 15, 1980 [GB] United Kingdom ..... 8012336

[51] Int. Cl.[3] ..... B65H 19/14; B65H 19/18; B65H 19/20

[52] U.S. Cl. ..... 156/504; 156/505; 242/58.2; 242/58.4; 242/58.5; 242/58.6

[58] Field of Search ..... 156/504, 505, 502, 157, 156/159; 242/58, 58.1, 58.2, 58.3, 58.4, 58.5, 58.6

[56] References Cited

U.S. PATENT DOCUMENTS

| | | | |
|---|---|---|---|
| 3,730,811 | 5/1973 | Wendt | 156/505 |
| 3,858,819 | 1/1975 | Butler, Jr. | 242/58.3 |
| 4,190,483 | 2/1980 | Ryan et al. | 156/505 |
| 4,284,463 | 8/1981 | Wright | 156/504 |

FOREIGN PATENT DOCUMENTS

| | | | |
|---|---|---|---|
| 1082033 | 9/1967 | United Kingdom | 242/58.2 |

*Primary Examiner*—Michael G. Wityshyn
*Attorney, Agent, or Firm*—Antonelli, Terry & Wands

[57] ABSTRACT

A bobbin changer, for use in producing a continuous supply of web by joining the webs from a succession of reels, comprises a splicing device for joining the leading end of the web on each new reel to the web on the expiring reel; at least two cradles for receiving and supporting reels of web during use, each having means for locating the end of the web of a new reel in readiness for splicing; and means for movably supporting each of the cradles whereby each cradle in turn can be moved from a standby position to a position aligned with the splicing device in preparation for a splicing operation.

13 Claims, 4 Drawing Figures

BOBBIN CHANGER FOR JOINING SUCCESSIVE REELS OF WEB OF THE CIGARETTE INDUSTRY

This invention is concerned with devices commonly known in the cigarette industry as "bobbin changers". A bobbin changer is a device by which the trailing end of a web drawn from one reel (i.e. when the reel is about to expire) is joined to the leading end of the web on the next reel to be used, so as to maintain a continuous supply of the web.

This invention is particularly concerned with a bobbin changer for use in connection with the types of web used in a filter attachment machine for joining filters to cigarettes.

A bobbin changer according to this invention comprises a splicing device for joining the leading end of the web on each new reel to the web on the expiring reel; at least two cradles for receiving and supporting reels of web during use, each having means for locating the end of the web of a new reel in readiness for splicing; and means for movably supporting each of the cradles whereby each cradle in turn can be moved from a standby position to an operative position aligned with the splicing device in preparation for a splicing operation.

There is preferably a reservoir in which a length of web can be accumulated in preparation for a splicing operation and from which web is drawn while the splicing operation is taking place.

When a reel is about to expire, the tail end of the web on that reel is preferably cut off and is held (e.g. by suction) in a splicing position while the cradles are moved to bring a new reel to the position in which the web on that reel can be joined to the tail end of the previous reel. The joint is preferably formed by a double-sided adhesive tape which is initially applied to the web on the new reel; this last web is preferably pressed automatically against the tail end portion of the web on the previous reel for that purpose.

An example of a bobbin changer according to this invention is shown in the accompanying drawings. In these drawings.

Figure 2:
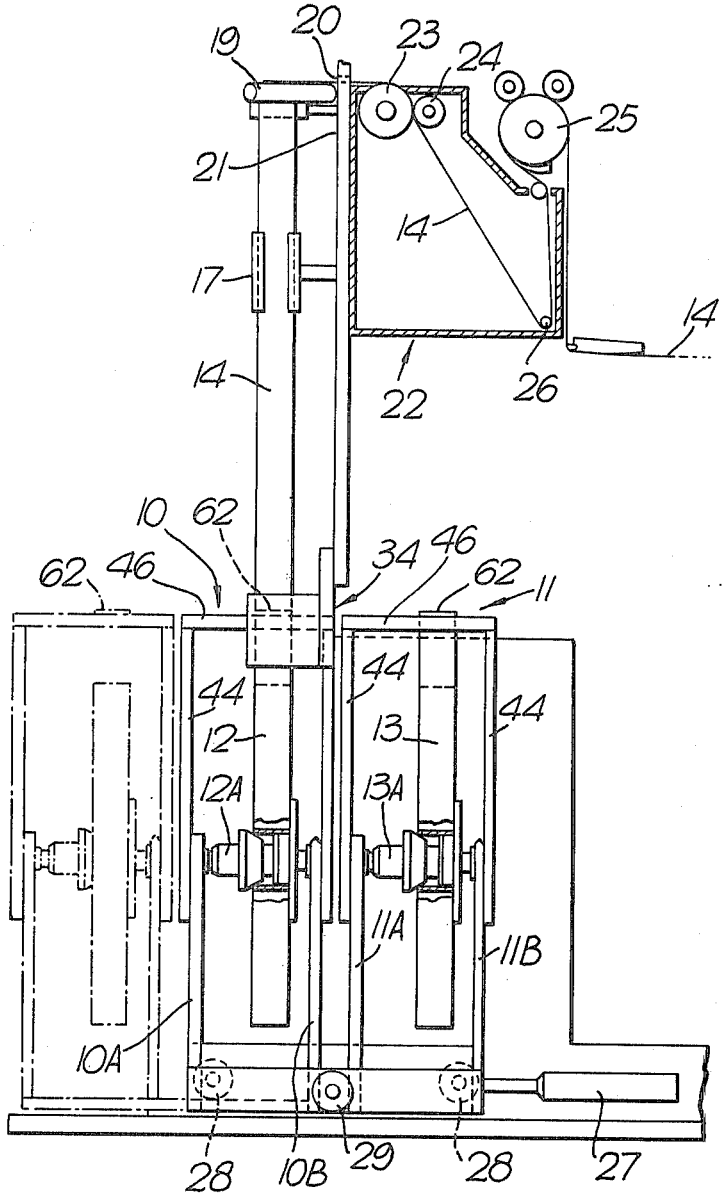
FIG. 2 is an front view of the bobbin changer.

As shown in FIG. 2, the bobbin changer includes two cradles 10 and 11 carrying two reels 12 and 13. The reel 12 is in the operative position in which web 14 is being drawn from the reel via a lateral guide 17, a further roller 18 and an inclined roller 19 which deflects the web through a slot 20 in a wall 21 of the machine. After passing through the wall 21, the web enters a reservoir 22; it is driven into the reservoir by a drive roller 23 with the aid of a pinching roller 24, and is drawn from the reservoir by a further drive roller 25.

The roller 25 is driven at a set speed depending upon the speed at which the web is required to be fed to the filter attachment machine. A variable-speed motor is provided to drive the roller 23; the speed is approximately controlled in response to the speed of the filter attachment machine and is finely varied in response to upward and downward movement of a sensing finger 26 (e.g. in the manner described in British Pat. No. 1086065); and there is also provision for increasing the speed of the motor in order to accumulate web in the reservoir in preparation for a splicing operation.

The two cradles 10 and 11 are connected together and are horizontally movable sideways by a pneumatic actuator 27. This actuator (which is shown in a retracted position) can be extended so as to move the cradle 10 to the position shown in chain dotted outline, the cradle 11 then being at the operative position occupied by the cradle 10 in FIG. 2. The double cradle assembly 10, 11 has back wheels 28 and a front wheel 29 which run on tracks 30 and 31 respectively, the track 30 having a groove to locate the cradles against inadvertent forward or backward movement.

Each of the cradles has side walls 10A, 10B and 11A, 11B for supporting the ends of a spindle 12A or 13A in the corresponding reel. A full reel can be rolled into position along the upper edges of the side walls (as shown in chain dotted outline in FIG. 1) until the spindle drops into slots 30B in the side walls. When the expired reel is required to be removed, a retaining member 30A is moved upwards or outwards to allow the spindle with the core of the emptied reel to run down a downwardly sloping track 32 shown in FIG. 1 (but not in FIG. 2).

Figure 1:
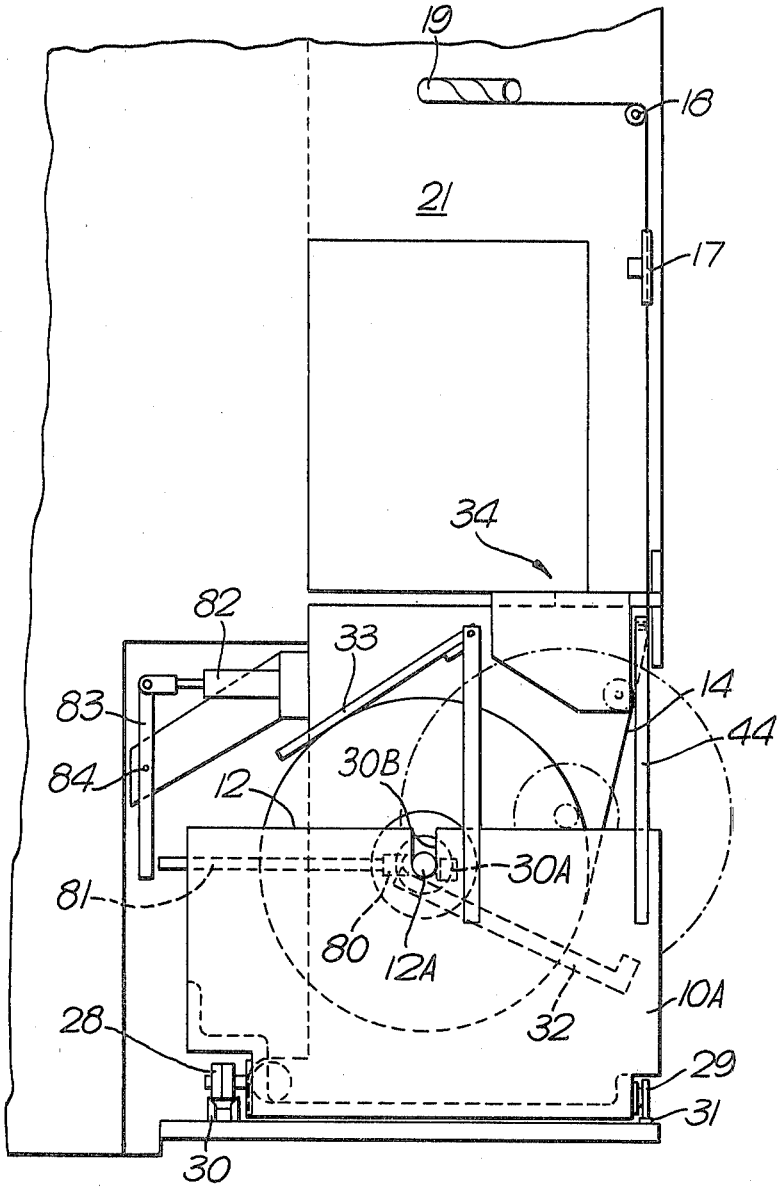
FIG. 1 is a side view of the bobbin changer.

A full reel 12 is shown in the operative position in FIG. 1. When the reel reaches a nearly empty state, as detected in a known manner by a pivoted arm 33, the motor driving the roller 23 automatically increases its speed so as to accumulate web in the reservoir 22, and after a predetermined time interval (or when the arm 33 detects that the reel is substantially empty) that motor is stopped to allow an automatic splicing operation to take place. Splicing is carried out by a mechanism 34 of which details are shown in FIG. 3.

Figure 3:
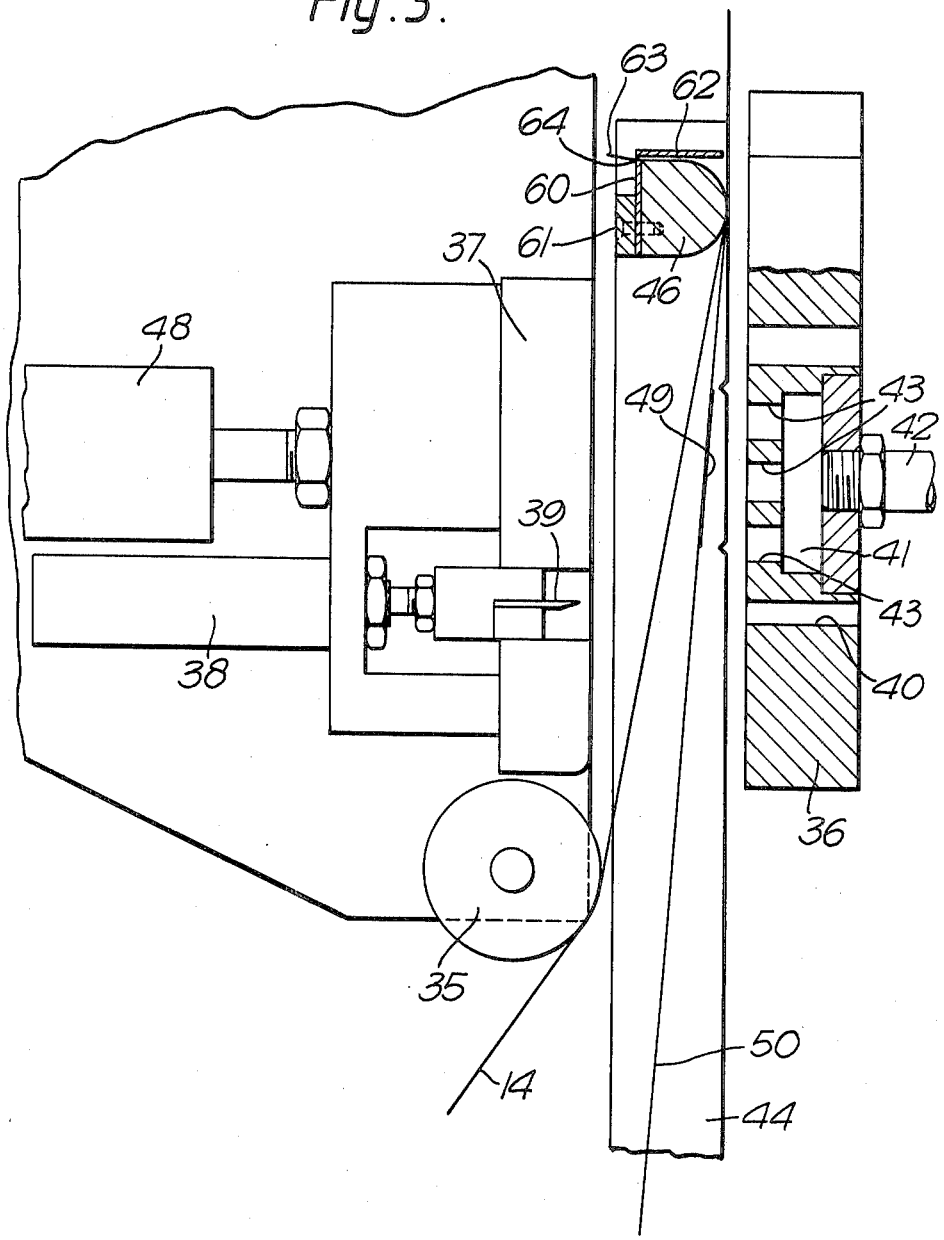
FIG. 3 is an enlargement of part of FIG. 1.

FIG. 3 shows the operative web 14 running round a guide roller 35 which defines the path of the web between a fixed member 36 and a movable member 37. When the web 14 is stopped to allow splicing to take place, a pneumatic actuator 48 carried by a fixed frame (not shown) is extended to move the member 37 to the right, preferably far enough to clamp the web against the member 36. A pneumatic actuator 38 is then extended to move a knife 39 to the right. The edge of the knife 39 enters a recess 40 in the member 36 so as to cut the web. At the same time, suction is applied to a manifold 41 through a pipe 42 to hold against the member 36 the part of the web 14 lying above the knife 39; for that purpose there are suction ports 43 extending from the manifold 41 to the outer face of the member 36. The tail end of the web (below the knife) falls away and is removed when the operator removes the expired reel. The actuators 48 and 38 are then both retracted.

Each of the cradles has two vertically extending side arms 44 carrying, at their upper ends, a cross bar 46 at the top. The web on the standby reel is prepared as follows: its end is pulled upwards between the side arms 44 and over the cross bar 46, to which it is clamped in the following manner. The cross bar carries a clamping member (e.g. of resilient plastics material) having a vertical part 60 which is secured to the cross bar by screws 61, and a horizontal part 62 which can be lifted to allow the end 63 of the web to be pushed underneath it and through a slot 64 in the part 60; when it is released, the part 62 lightly grips the web, allowing it to be pulled out when the standby reel starts to be used following a splicing operation. The end portion 63 of the web is preferably torn off by the operator along the edge of the slot 64 to minimize the length of the tail of web which will trail behind the splice. The position of the web at this stage is shown by the line 50.

After the operative web 14 has been stopped and then cut by the knife 39, the cradles are moved automatically by the actuator 27 so as to bring the reel 13 to the operative position. The pneumatic actuator 48 is then again extended to move the member 37 to the right and thus press the webs together. A piece of double-side adhesive tape 49 (previously placed on the standby web) joins the two webs together. The actuator 48 is then retracted and the motor driving the roller 23 is again switched on.

After the splicing operation just described, the cradle 10 will occupy the position shown in chain dotted outline in FIG. 2. The empty reel in it can then be replaced by a full reel which is prepared for the next splicing operation in the manner described above.

The above automatic operation can be controlled by a readily available timing and control device.

Figure 4:
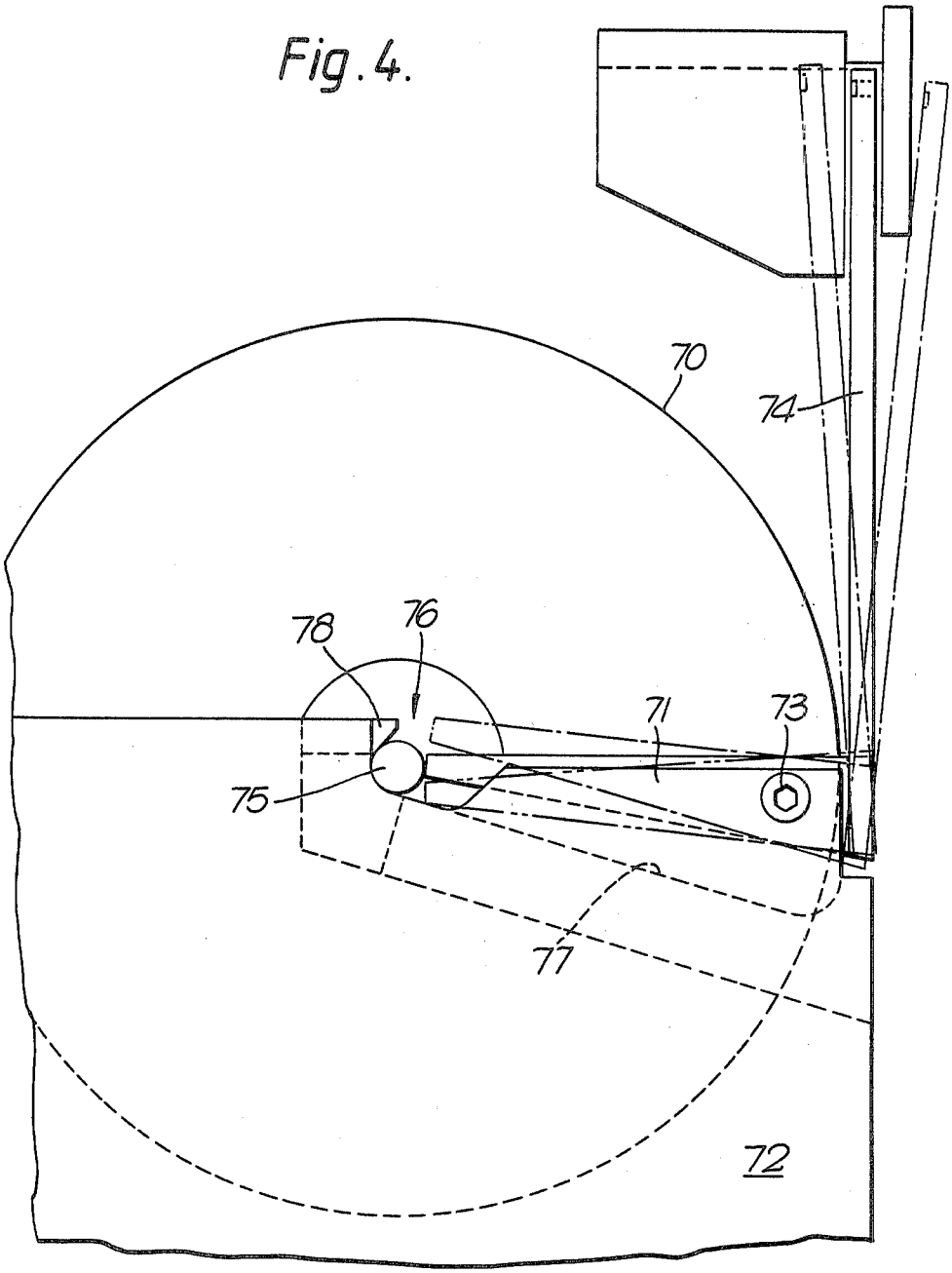
FIG. 4 shows a modification of the upper edge of each cradle.

FIG. 4 shows a modification of the upper edge region of each cradle. To facilitate the location of a new reel, the portion of the upper edge along which a reel 70 is rolled is formed by a part 71 which is pivoted to the corresponding side wall 72 of the cradle by a bolt 73. An arm 74 (corresponding to arm 44 in FIG. 3) is secured to the pivoted part 71.

When a new reel is rolled into position on the cradle, its weight pushes the part 71 downwards (preferably against the action of a light return spring which is not shown) to the lowest of the three positions shown in FIG. 5, thus allowing the reel to roll easily along the part 71 until the spindle 75 in the reel drops off the left-hand end of the part 71 and enters a socket 76. The part 71 is then raised to the middle position, either by the spring or manually by the operator or automatically by a guide (not shown) arranged to engage the arm 74 as the cradle is moved towards the operative position by the actuator 27 (FIG. 1).

When the expired reel is required to be removed from the cradle, the operator pulls one of the arms 74 to raise the part 71 on each side of the cradle preferably against the action of a light return spring which is not shown, thus allowing the spindle 75 to roll down internal ramps 77 in the cradle.

While the reel is in use, a projection 78 on each side wall of the cradle cooperates with the end of the part 71 to prevent the reel from rising inadvertently out of the socket 76.

In place of the clamping members 60, 62 shown in FIG. 3, other means may be provided on each cross-bar 46 for releasable retaining or clamping the end of the web of the standby reel. For example, a spring-loaded clamp may be fitted to the front face of the cross-bar. Alternatively, the cross-bar may have a row of upwardly-extending pins along the top, the web being secured by being pushed onto the pins.

As shown in FIG. 1, each cradle includes a friction brake 80 mounted on the end of a horizontally slidable push-rod 81. When the in-use reel is required to stop (e.g. when the filter attachment machine is switched off), a pneumatic actuator 82 mounted on the machine frame is extended so as to rotate a lever 83 in a counterclockwise direction about a fixed pivot 84, whereby the lower end of the lever pushes the rod 81 to the right and thereby urges the brake 80 against a part of the spindle of the in-use reel.

I claim:

1. A bobbin changer comprising a splicing device for joining the leading end of the web on each new reel to the web on the expiring reel; at least two cradles for receiving and supporting reels of web during use, each having means for locating the end of the web of a new reel in readiness for splicing, said cradles being connected together and arranged to be moved in unison in the direction of the axes of the reels; and means for movably supporting each of the cradles whereby each cradle in turn can be moved from a standby position to an operative position aligned with the splicing device in preparation for a splicing operation.

2. A bobbin changer according to claim 1 in which each cradle has an upwardly extending arm which carries a cross-bar including means for releasably holding the end of the web on each new reel in the position needed for splicing.

3. A bobbin changer according to claim 1 in which each cradle includes side walls along the top of which a new reel can be rolled into position.

4. A bobbin changer according to claim 3 in which each side wall includes a socket for receiving one end of a spindle in the reel, means for retaining the spindle in the socket, and an internal ramp down which the spindle can slide when released by the retaining means.

5. A bobbin changer according to claim 4 in which the retaining means comprises upper portions of the side walls which are pivoted to main parts of the side walls so as to form a downwardly sloping ramp down which a new bobbin can be rolled towards the sockets, the spindle being released from the sockets by pivoting the said upper portions in an upward direction.

6. A bobbin changer according to claim 5 in which each pivoted upper portion of each side wall carries an upwardly extending arm which carries a cross-bar connected between the upper ends of the two arms, including means on said cross-bar for releasably holding the end of the web on each new reel in the position needed for splicing.

7. A bobbin changer according to claim 1 including a reservoir through which the web is arranged to pass, downstream of the splicing device, and in which web can be accumulated prior to splicing, so that the web can be stopped at the splicing device during splicing while web continues to pass from the reservoir.

8. A bobbin changer comprising a splicing device for joining the leading end of the web on each new reel to the web on the expiring reel; at least two cradles for receiving and supporting reels of web during use, each having means for locating the end of the web of a new reel in readiness for splicing, the locating means comprising an upwardly-extending arm which carries a cross-bar including means for releasably holding the end of the web on each new reel in the position needed for splicing; and means for movably supporting each of the cradles whereby each cradle in turn can be moved from a standby position to an operative position aligned with the splicing device in preparation for a splicing operation; said splicing device including a fixed member and an opposed movable member, said movable member and an opposed portion of said fixed member being set at a level below the cross-bar of each cradle, the leading end portion of a new reel being moved into a position between the fixed and movable members when the cradle carrying that reel is moved to the operative position, splicing being effected by movement of the movable member towards the fixed member.

9. A bobbin changer according to claim 8 in which the fixed member includes suction ports for gripping the expiring web, once it has stopped, in preparation for splicing, and in which the splicing device includes a knife arranged to cut the expiring web below the suction ports to remove the tail end.

10. A bobbin changer according to claim 9 in which the knife is carried by the movable member.

11. A bobbin changer comprising a splicing device for joining the leading end of the web on each new reel to the web on the expiring reel; at least two cradles for receiving and supporting reels of web during use, each having means for locating the end of the web of a new reel in readiness for splicing, the locating means including an upwardly-extending arm which carries a cross-bar including means for releasably holding the end of the web on each new reel in the position needed for splicing; and means for movably supporting each of the cradles whereby each cradle in turn can be moved from a standby position to an operative position aligned with the splicing device in preparation for a splicing operation; the splicing device including a fixed member having suction ports for gripping the expiring web, once it has stopped, in preparation for splicing, and an opposed movable member, said movable member and an opposed portion of said fixed member being set at a level below the cross-bar of each cradle, the leading end portion of a new reel being moved into a position between the fixed and movable members when the cradle carrying that reel is moved to the operative position, splicing being effected by movement of the movable member towards the fixed member, the splicing device further including a knife carried by the movable member and arranged to cut the expiring web below the suction portions to remove the tail end, in which the movable member is arranged to press the expiring web against the fixed member while the knife is being operated to cut the web.

12. A bobbin changer comprising a splicing device for joining the leading end of the web on each new reel to the web on the expiring reel; at least two cradles for receiving and supporting reels of the web during use, each having means for locating the end of the web of a new reel in readiness for splicing, the locating means including an upwardly-extending arm which carries a cross-bar including means for releasably holding the end of the web on each new reel in the position needed for splicing, and means for movably supporting each of the cradles whereby each cradle in turn can be moved from a standby position to an operative position aligned with the splicing device in preparation for a splicing operation; the splicing device including a fixed member having suction ports for gripping the expiring web, once it has stopped, in preparation for splicing, and an opposed movable member, said movable member and an opposed portion of said fixed member being set at a level below the cross-bar of each cradle, the leading end portion of a new reel being moved into a position between the fixed and movable members when the cradle carrying that reel is moved to the operative position splicing being effected by movement of the movable member towards the fixed member, the splicing device further including a knife arranged to cut the expiring web below the suction ports to remove the tail end, the arrangement being such that, after the tail end of expiring web has been cut by the knife, the means moving the cradles is arranged to operate to bring the new web to a position between the old web and the movable member, whereby movement of the movable member towards the fixed member will press the two webs together and effect a joint by means of adhesive carried by the new web, for example, in the form of double-sided adhesive tape.

13. A bobbin changer comprising a splicing device for joining the leading end of the web on each new reel to the web on the expiring reel; at least two cradles for receiving and supporting reels of web during use, each having means for locating the end of the web of a new reel in readiness for splicing; the locating means including an upwardly-extending arm which carries a cross-bar including means for releasably holding the end of the web on each new reel in the position needed for splicing, and means for movably supporting each of the cradles whereby each cradle in turn can be moved from a standby position to an operative position aligned with the splicing device in preparation for a splicing operation, the said means on the cross-bar for releasably holding the end of the web comprising a resilient clamping member.

* * * * *